US011056295B2

(12) United States Patent
Takahashi et al.

(10) Patent No.: US 11,056,295 B2
(45) Date of Patent: Jul. 6, 2021

(54) LIMIT SWITCH

(71) Applicant: OMRON Corporation, Kyoto (JP)

(72) Inventors: Manabu Takahashi, Okayama (JP); Kazuyuki Tsukimori, Okayama (JP); Kouhei Yoshida, Okayama (JP); Hiroyasu Komeyama, Kurayoshi (JP); Makoto Komatsu, Okayama (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 16/645,627

(22) PCT Filed: Mar. 6, 2019

(86) PCT No.: PCT/JP2019/008737
§ 371 (c)(1),
(2) Date: Mar. 9, 2020

(87) PCT Pub. No.: WO2019/176664
PCT Pub. Date: Sep. 19, 2019

(65) Prior Publication Data

US 2021/0027958 A1 Jan. 28, 2021

(30) Foreign Application Priority Data

Mar. 14, 2018 (JP) ..... JP2018-046938

(51) Int. Cl.
*H01H 21/28* (2006.01)

(52) U.S. Cl.
CPC ..... *H01H 21/28* (2013.01)

(58) Field of Classification Search
CPC ..... H01H 21/285; H01H 13/18; H01H 2021/287; H01H 3/16; H01H 21/28;
(Continued)

(56) References Cited

U.S. PATENT DOCUMENTS

2013/0047778 A1* 2/2013 Zhou ..... H01H 21/285 74/526
2014/0374224 A1 12/2014 Takahashi et al.

FOREIGN PATENT DOCUMENTS

CN 202189713 U 4/2012
JP 3959826 B2 8/2007
(Continued)

OTHER PUBLICATIONS

International Search Report dated Jun. 4, 2019; International Application No. PCT/JP2019/008737; International Filing Date Mar. 6, 2019; 4 pages.

(Continued)

*Primary Examiner* — Ahmed M Saeed
(74) *Attorney, Agent, or Firm* — Cantor Colburn LLP

(57) ABSTRACT

A limit switch is provided with a switch body having a contact mechanism inside, and an operation unit detachably connected to the switch body. The operation unit may include a pivoting shaft and a bearing. One of the pivoting shaft and the bearing includes a protrusion that extends in a radial direction with respect to the pivoting shaft. The other of the pivoting shaft and the hearing includes a pivoting restriction part that is disposed around the pivoting shaft so as to be able to contact the protrusion, and restricts pivoting of the protrusion around the pivoting shaft.

2 Claims, 7 Drawing Sheets

(58) Field of Classification Search
CPC ..... H01H 3/42; H01H 2221/01; H01H 2231/038; H01H 13/365; H01H 19/62; H01H 21/22; H01H 3/04; H01H 3/3015; H01H 19/18; H01H 3/46; H01H 11/0006; H01H 1/58
See application file for complete search history.

(56) References Cited

FOREIGN PATENT DOCUMENTS

| | | | |
|---|---|---|---|
| JP | 2013045769 | A | 3/2013 |
| JP | 2013145676 | A | 7/2013 |
| JP | 2015204223 | A | 11/2015 |

OTHER PUBLICATIONS

Written Opinion of the International Searching Authority; International Application No. PCT/JP2019/008737; International Filing Date Mar. 6, 2019; dated Jun. 4, 2019; 9 pages.
TW Office Action corresponding to TW108107635, dated Jun. 19, 2018 with English Translation; 10 pages.

* cited by examiner

LIMIT SWITCH

CROSS REFERENCE TO RELATED APPLICATIONS

This is the U.S. national stage of application No. PCT/JP2019/008737, filed on Mar. 6, 2019. Priority under 35 U.S.C. § 119(a) and 35 U.S.C. § 365(b) is claimed from Japanese Application No. 2018-046938 filed Mar. 14, 2018, the disclosure of which is also incorporated herein by reference.

TECHNICAL FIELD

The present disclosure relates to a limit switch.

BACKGROUND ART

Patent Document 1 discloses a limit switch provided with a housing in which a built-in switch is housed. This limit switch includes a shaft extending from the outside to the inside of the housing and pivotably supported by the housing, and an arm that is connected to the end of the shaft on the outer side of the housing and can pivot the shaft.

The limit switch is configured such that, when an external force is applied to the arm to pivot the arm from an initial position, a cam connected to the shaft inside the housing turns to turn on a built-in switch, and when the external force being applied to the arm is released, the arm returns to the initial position to turn off the built-in switch.

PRIOR ART DOCUMENT

Patent Document

Patent Document 1: JP 2015-204223 A

SUMMARY OF INVENTION

Subjects to be Solved by the Invention

In the limit switch, when an external force larger than expected is applied to the arm, a drive component for turning on and off the limit switch such as a cam may be broken, and the limit switch may break down. In this case, it takes time to repair the limit switch, which might cause lack of convenience.

An object of the present disclosure is to provide a highly convenient limit switch that is easy to repair.

Means for Solving the Subjects

An example of a limit switch of the present disclosure is provided with:

a switch body having a contact mechanism inside; and an operation unit detachably connected to the switch body.

The operation unit includes a housing body connected to the switch body, a pivoting shaft extending from an outside of the housing body to an inside of the housing body and pivotable around an extending direction of the pivoting shaft, a bearing that is provided in the housing body and pivotably supports the pivoting shaft, and an operation lever that is connected to the pivoting shaft outside the housing body, and pivots the pivoting shaft to turn on and off the contact mechanism.

One of the pivoting shaft and the bearing includes a protrusion that extends in a radial direction with respect to the pivoting shaft, and the other of the pivoting shaft and the bearing includes a pivoting restriction part that is disposed around the pivoting shaft so as to be able to contact the protrusion, and restricts pivoting of the protrusion around the pivoting shaft.

Effects of the Invention

According to the limit switch, the operation unit detachably connected to a switch body is provided, and in the operation unit, one of the pivoting shaft and the bearing includes a protrusion that extends in a radial direction with respect to the pivoting shaft, and the other of the pivoting shaft and the bearing includes a pivoting restriction part that is disposed around the pivoting shaft so as to be able to contact the protrusion, and restricts pivoting of the protrusion around the pivoting shaft. That is, the limit switch restricts the pivoting of the operation lever by restricting the pivoting of the pivoting shaft in the pivoting shaft and the bearing. Thereby, even when an external force of a magnitude larger than expected is applied to the operation lever from the pivoting direction thereof, it is possible to prevent the breakage of the drive component that turns on and off the contact mechanism, and hence the limit switch can be repaired simply by replacing the operation unit, for example. That is, a limit switch that is easy to repair and highly convenient can be achieved.

MODES FOR CARRYING OUT THE INVENTION

Hereinafter, an example of the present disclosure will be described with reference to the accompanying drawings. In the following description, terms indicating specific directions or positions (e.g., terms including "up," "down," "right," and "left,") will be used as necessary, but the use of those terms is to facilitate understanding of the present disclosure with reference to the drawings, and the technical scope of the present disclosure is not limited by the meanings of those terms. The following description is essentially mere illustration and does not intend to restrict the present disclosure, its application, or its use. Further, the drawings are schematic, and the ratio of each dimension, or the like, does not necessarily match an actual one.

Figure 1:
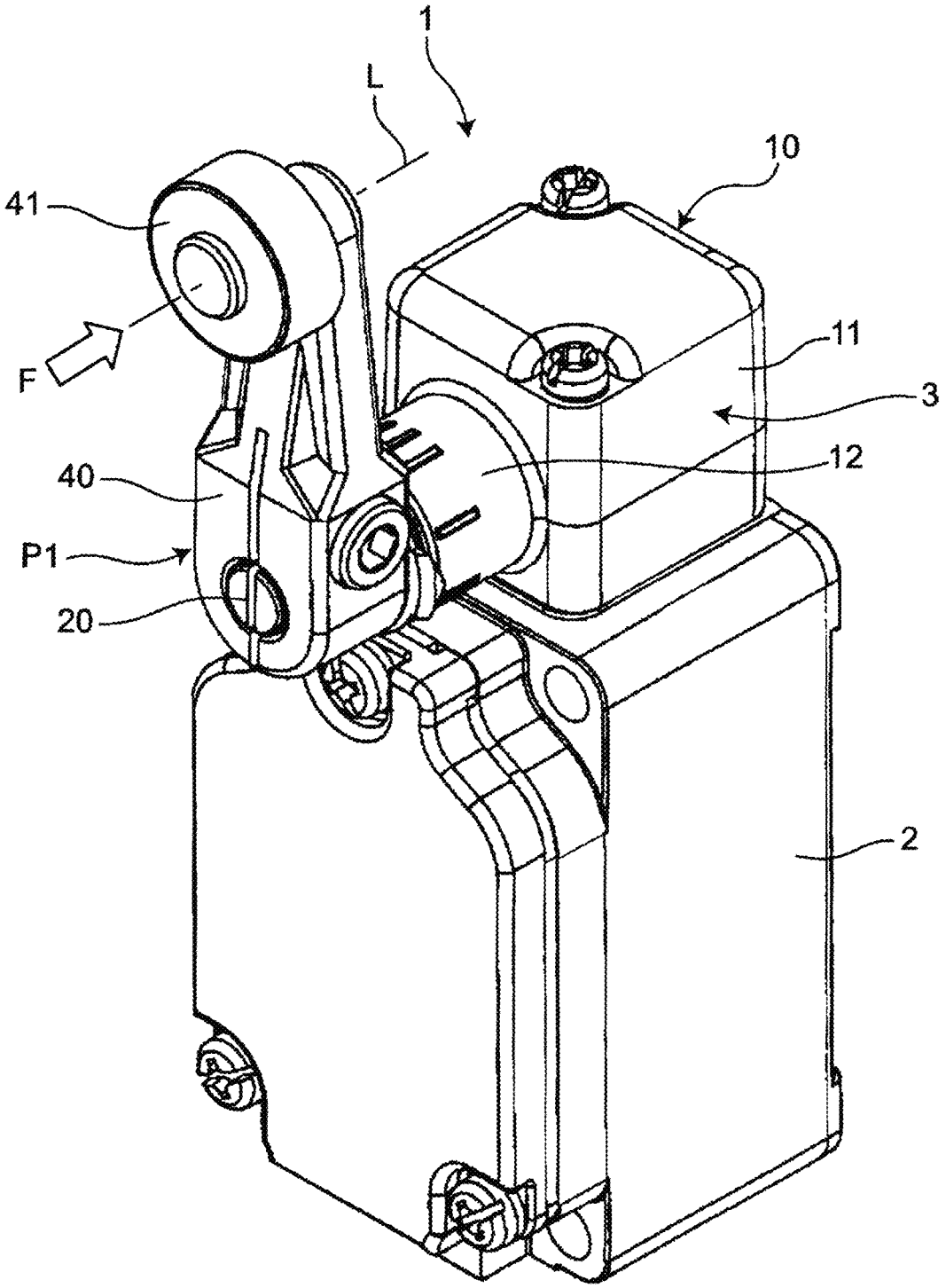
FIG. 1 is a perspective view illustrating a limit switch according to an embodiment of the present disclosure.

As illustrated in FIG. 1, a limit switch 1 according to an embodiment of the present disclosure is provided with a switch body 2 having a contact mechanism (not illustrated) inside, and an operation unit 3 detachably connected to the switch body 2.

As illustrated in FIG. 1, the switch body 2 has a hollow, substantially rectangular parallelepiped shape, and the operation unit 3 is connected to one of the side surfaces facing each other in the longitudinal direction (i.e., the upper surface in FIG. 1).

As illustrated in FIG. 1, the operation unit 3 includes: a housing 10; a pivoting shaft 20 extending from the outside of the housing 10 to the inside of the housing 10 and pivotable around the extending direction of the pivoting shaft 20; a bearing 30 (cf. FIG. 3) that is provided in the housing 10 and pivotably supports the pivoting shaft 20; and an operation lever 40 connected to the pivoting shaft 20 outside the housing 10.

Figure 2:
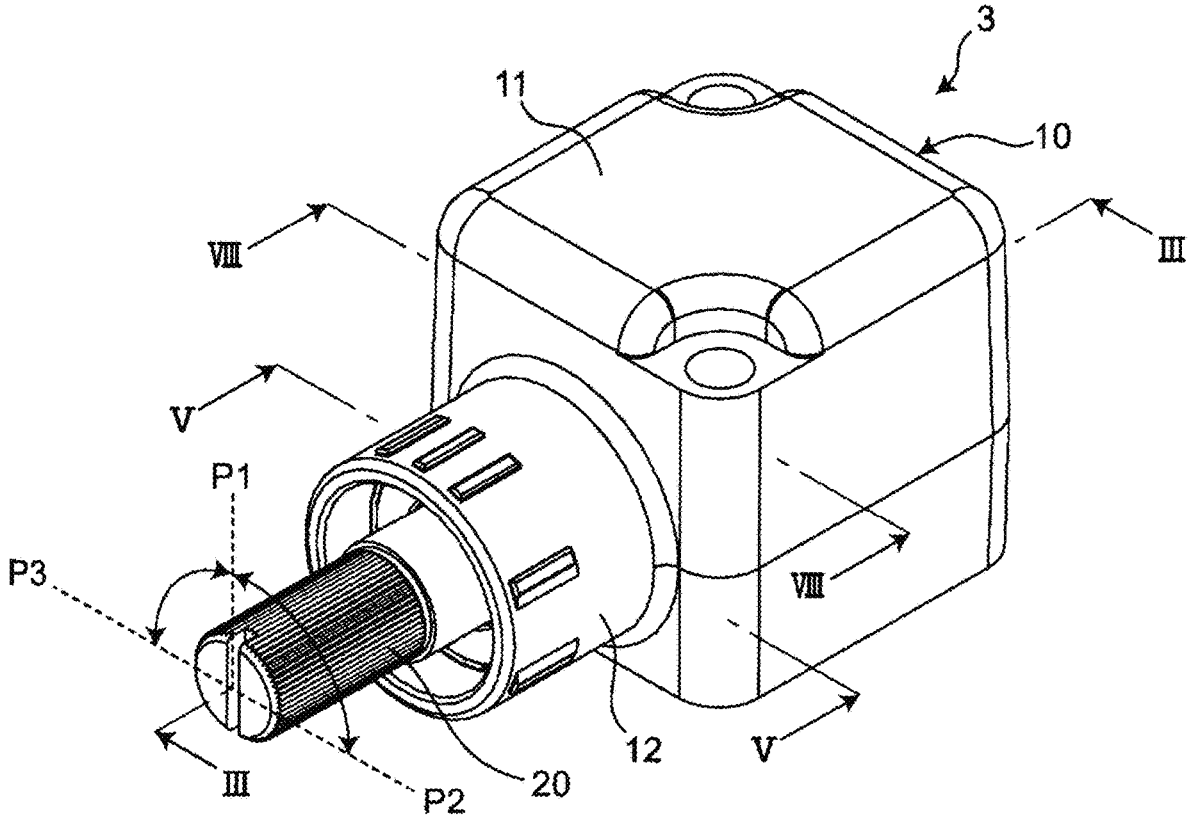
FIG. 2 is a perspective view illustrating an operation unit in a state where an operation lever of the limit switch in FIG. 1 has been removed.

As illustrated in FIG. 2, the housing 10 includes a hollow, substantially cubic housing body 11 connected to the switch body 2, and a peripheral wall 12 provided on one surface of the housing body 11. The housing body 11 is provided with the bearing 30, and the pivoting shaft 20 extending from the outside of the housing body 11 to the inside of the housing body 11 is pivotably supported by the bearing 30. The peripheral wall 12 has a substantially cylindrical shape as an example, and surrounds the bearing 30 around the pivoting shaft 20 outside the housing body 11, as illustrated in FIG. 3.

As illustrated in FIG. 2, the pivoting shaft 20 has a substantially columnar shape and is configured to be pivotable around the extending direction thereof.

Figure 3:
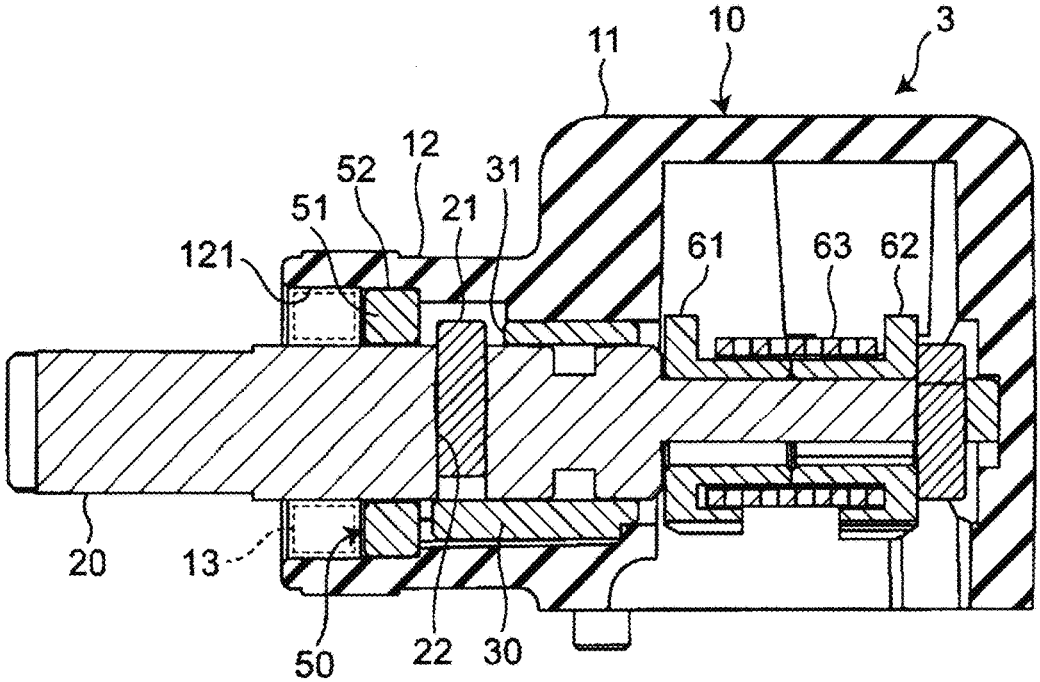
FIG. 3 is a sectional view taken along line in FIG. 2.

As illustrated in FIG. 3, the pivoting shaft 20 includes a protrusion 21 extending in a radial direction with respect to the pivoting shaft 20, and a recess 22 extending in a direction intersecting with (e.g., orthogonal to) the extending direction of the pivoting shaft 20 to house and hold the protrusion 21. The protrusion 21 is configured by a separate member from that of the pivoting shaft 20, and a part of the protrusion 21 is press-fitted into the recess 22 to be housed and held therein. Each of the protrusion 21 and the recess 22 is closer to the inside of the housing body 11 than a sealer 13 to be described later in the extending direction of the pivoting shaft 20, and the protrusion 21 is disposed to contact a pivoting restriction part 31 of the bearing 30 to be described later in the circumferential direction of the pivoting shaft 20. That is, the pivoting of the protrusion 21 around the pivoting shaft 20 is restricted by the pivoting restriction part 31 of the bearing 30 to define the pivoting range of the pivoting shaft 20.

Figure 4:
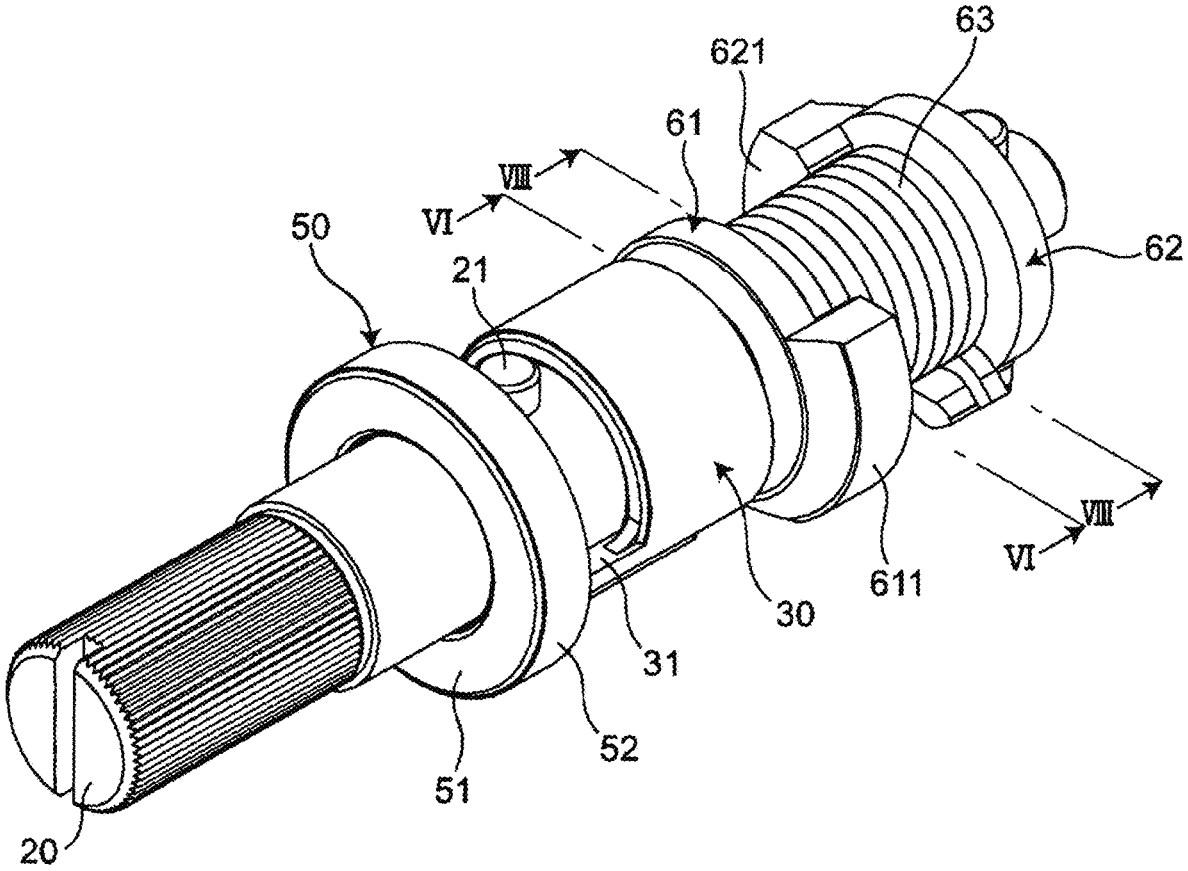
FIG. 4 is a perspective view illustrating the operation unit in a state where a housing and an operation lever of the limit switch in FIG. 1 have been removed.

As illustrated in FIG. 3, the bearing 30 is provided in the housing body 11, and the end of the housing body 11 is surrounded by the peripheral wall 12, the end being farther from the inside of the housing body 11. As illustrated in FIG. 4, the bearing 30 has a substantially cylindrical shape capable of pivotably supporting the pivoting shaft 20, and the pivoting restriction part 31 is provided at the end of the housing body 11, the end being farther from the inside of the housing body 11.

Figure 5:
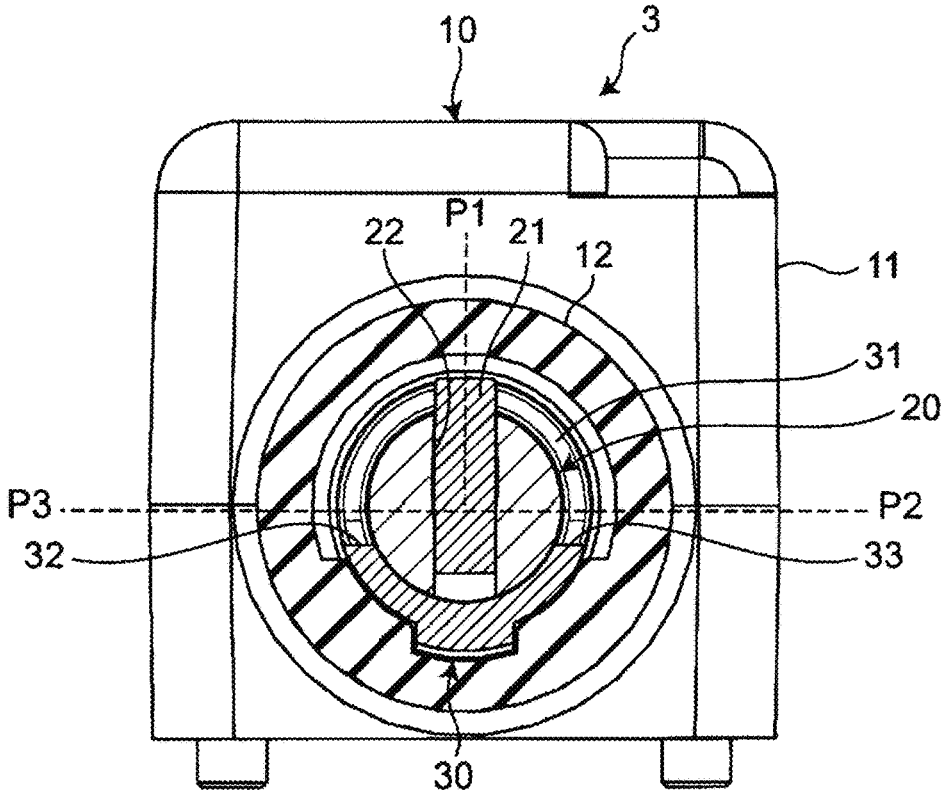
FIG. 5 is a sectional view taken along line V-V in FIG. 2.

As illustrated in FIG. 5, the pivoting restriction part 31 is configured by a notch extending in the circumferential direction with respect to the pivoting shaft 20, and a first end 32 and a second end 33 in the circumferential direction with respect to the pivoting shaft 20 contacts the protrusion 21 of the pivoting shaft 20 to restrict the pivoting of the protrusion 21 of the pivoting shaft 20 around the pivoting shaft 20.

Note that the sealer 13 is provided within the peripheral wall 12 and at the end of the housing body 11, the end being farther from the inside than the bearing 30 in the extending direction of the pivoting shaft 20. The sealer 13 is configured by, for example, an oil seal, and seals the inside of the housing body 11.

As illustrated in FIG. 1, the operation lever 40 is disposed outside the housing body 11 and extends in a direction intersecting with (e.g., orthogonal to) the pivoting shaft 20. One end of the operation lever 40 in the extending direction thereof is connected to the pivoting shaft 20 so that the pivoting shaft 20 can be pivoted together with the pivoting of the operation lever 40. A roller 41 is provided at the other end of the operation lever 40 in the extending direction thereof so as to be pivotable around a pivoting axis L substantially parallel to the pivoting shaft 20.

As illustrated in FIG. 2, the operation lever 40 is configured to be pivotable between an intermediate return position P1 disposed at intervals in the circumferential direction with respect to the extending direction of the pivoting shaft 20 and each of a first motion position P2 and a second motion position P3 at both ends. In the limit switch 1, the return position P1, the first motion position P2, and the second motion position P3 are disposed at an interval of about 90 degrees from each other in the circumferential direction around the pivoting shaft 20. In FIG. 2, a center line extending in the extending direction of the operation lever 40 is indicated by a dotted line.

As illustrated in FIG. 1, the operation lever 40 is located at the return position P1 in a state where no external force is applied. At this time, the operation lever 40 extends in a direction away from the switch body 2 along the longitudinal direction of the switch body 2 from the pivoting shaft 20. In a state where the operation lever 40 is located at the return position P1, the contact mechanism in the switch body 2 is off.

On the other hand, when an external force in the circumferential direction with respect to the pivoting axis L is applied to the operation lever 40, the operation lever 40 pivots together with the pivoting shaft 20 from the return position P1 to the first motion position P2 or the second motion position P3. By the pivoting of the operation lever 40, a first cam 61 and a second cam 62 to be described later, which are connected to the pivoting shaft 20, pivot and the contact mechanism in the switch body 2 is switched from off to on. That is, the operation lever 40 is configured to pivot the pivoting shaft 20 to turn on and off the contact mechanism.

As illustrated in FIG. 5, in the limit switch 1, when the operation lever 40 is located at the first motion position P2, the protrusion 21 of the pivoting shaft 20 contacts the first end 32 of the pivoting restriction part 31 of the bearing 30 in the circumferential direction with respect to the pivoting shaft 20. When the operation lever 40 is located at the second motion position P3, the protrusion 21 of the pivoting shaft 20 contacts the second end 33 of the pivoting restriction part 31 of the bearing 30 in the circumferential direction with respect to the pivoting shaft 20

Further, as illustrated in FIG. 3, the operation unit 3 includes a pivoting shaft support 50. The pivoting shaft support 50 is provided around the pivoting shaft 20 at a position within the peripheral wall 12 and further away from the inside of the housing body 11 than the bearing 30 in the extending direction of the pivoting shaft 20.

Specifically, as illustrated in FIG. 4, the pivoting shaft support 50 is configured by a substantially annular second bearing 51 disposed over the circumference of the pivoting shaft 20. In a state where an external force along the extending direction of the pivoting shaft 20 (i.e., an external force F along the pivoting axis L illustrated in FIG. 1) is not applied to the operation lever 40, the second bearing 51 permits the pivoting of the pivoting shaft 20. In a state where the external force along the extending direction of the pivoting shaft 20 is applied to the operation lever 40, an end 52 on the outer side in the radial direction with respect to the pivoting shaft 20 contacts an inner circumferential surface 121 (illustrated in FIG. 3) of the peripheral wall 12 to support the pivoting shaft 20.

Further, as illustrated in FIG. 3, the operation unit 3 includes the first cam 61 and the second cam 62 that are each connected to the pivoting shaft 20 inside the housing body 11, and an elastic part 63 provided inside the housing body 11. The second cam 62 is disposed symmetrically with the first cam 61 with respect to the pivoting shaft 20.

Figure 6:
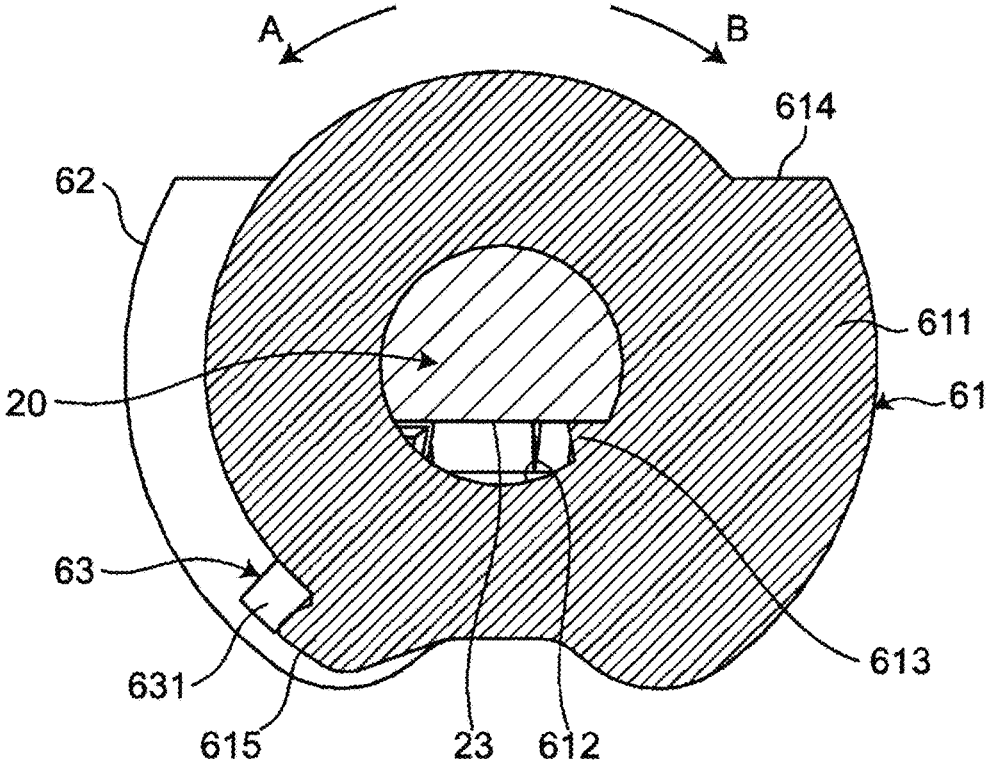
FIG. 6 is a sectional view taken along line VI-VI in FIG. 4.

As illustrated in FIG. 6, the pivoting shaft 20, to which the first cam 61, the second cam 62, and the elastic part 63 are connected, has substantially a semi-arc shape in cross section along the direction orthogonal to the extending direction of the pivoting shaft 20, and is formed with a locking surface 23 to which locking protrusions 613, 623 of the first cam 61 and a second cam 62 to be described later are locked.

As illustrated in FIG. 6, the first cam 61 includes a first transmitter 611 having an annular shape (including not only a complete annular shape but also a substantially annular shape provided with a notch), the first transmitter 611 pivoting together with the pivoting shaft 20 to turn on and off the contact mechanism when the operation lever 40 pivots from the return position P1 to the first motion position P2, the first transmitter 611 not pivoting together with the pivoting shaft 20 when the operation lever 40 pivots from the return position P1 to the second motion position P3. That is, the first transmitter 611 transmits to a drive component the power of the pivoting movement of the pivoting shaft 20 generated by the operation lever 40 pivoting from the return position P1 to the first motion position P2, to turn on and off the contact mechanism.

At a substantially center of the first cam 61, a substantially circular through-hole 612 is provided. On the inner circumferential surface of the through-hole 612, a locking protrusion 613 that locks with the locking surface 23 of the pivoting shaft 20 is provided. With the locking protrusion 613, when the operation lever 40 pivots in a second direction B from the return position P1 toward the first motion position P2, the first cam 61 pivots together with the pivoting shaft 20, while when the operation lever 40 is pivoted in a first direction A from the return position P1 toward the second motion position P3, the first cam 61 does not pivot together with the pivoting shaft 20 and permits the pivoting of the pivoting shaft 20 with respect to the first cam 61.

Figure 8:
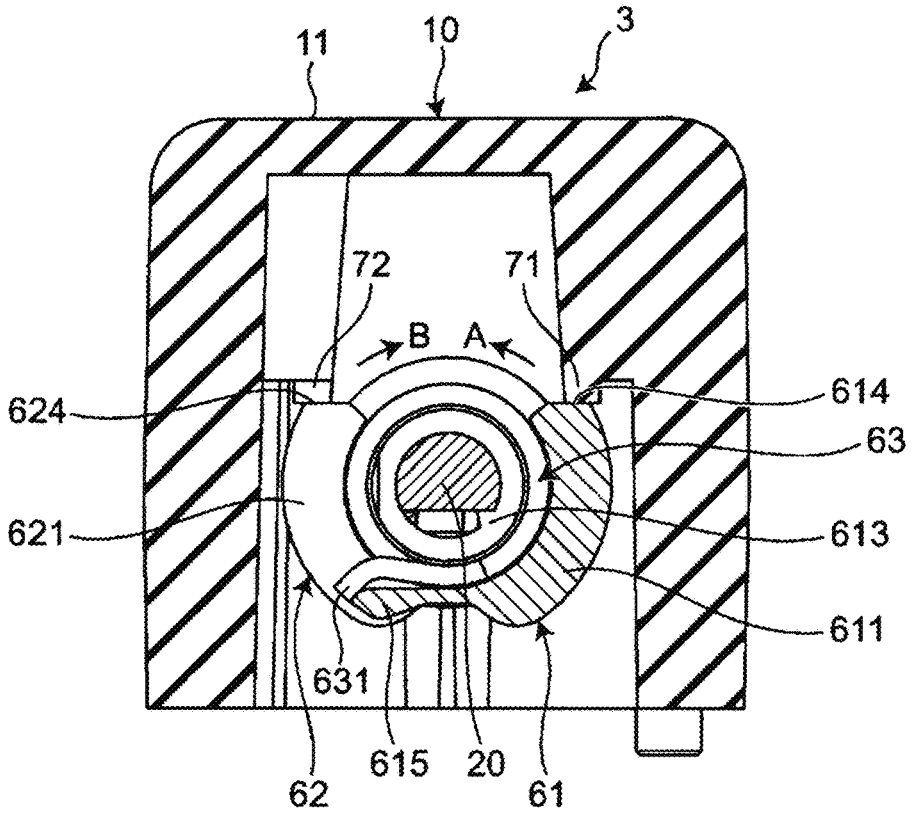
FIG. 8 is a sectional view taken along line VIII-VIII in FIG. 2.

A first contact surface 614 is provided at the end of the first transmitter 611 on the downstream side in the second direction B where the operation lever 40 moves from the return position P1 toward the first motion position P2. As illustrated in FIG. 8, the first contact surface 614 is disposed so as to contact a first contact protrusion 71 to be described later in a state where the operation lever 40 is located at the return position P1. Further, on the opposite side of the first contact surface 614 of the first transmitter 611 with respect to the pivoting shaft 20, a spring locking part 615 for locking a first end 631 of the elastic part 63 is provided.

Figure 7:
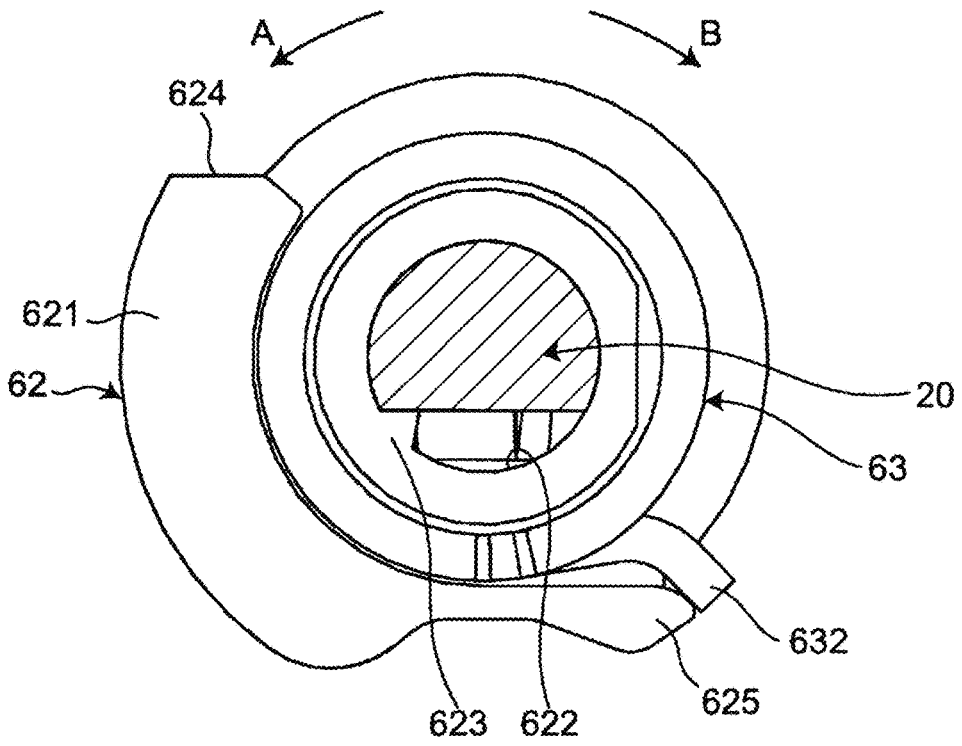
FIG. 7 is a sectional view taken along line VII-VII in FIG. 4.

As illustrated in FIG. 7, the second cam 62 includes a second transmitter 621 having an annular shape (including not only a complete annular shape but also a substantially annular shape provided with a notch), the second transmitter 621 pivoting together with the pivoting shaft 20 to turn on and off the contact mechanism when the operation lever 40 pivots from the return position P1 to the second motion position P3, the second transmitter 621 not pivoting together with the pivoting shaft 20 when the operation lever 40 pivots from the return position P1 to the first motion position P2. That is, the second transmitter 621 transmits to a drive component the power of the pivoting movement of the pivoting shaft 20 generated by the operation lever 40 pivoting from the return position P1 to the second motion position P3, to turn on and off the contact mechanism.

At a substantially center of the second cam 62, a substantially circular through-hole 622 is provided. On the inner circumferential surface of the through-hole 622, a locking protrusion 623 that locks with the locking surface 23 of the pivoting shaft 20 is provided. With the locking protrusion 623, when the operation lever 40 pivots in the first direction A from the return position P1 toward the second motion position P3, the second cam 62 pivots together with the pivoting shaft 20, while when the operation lever 40 is pivoted in the second direction B from the return position P1 toward the first motion position P2, the second cam 62 does not pivot together with the pivoting shaft 20 and permits the pivoting of the pivoting shaft 20 with respect to the second cam 62.

A second contact surface 624 is provided at the end of the second transmitter 621 on the downstream side in the first direction A where the operation lever 40 moves from the return position P1 to the second motion position P3. As illustrated in FIG. 8, the second contact surface 624 is disposed so as to contact a second contact protrusion 72 to be described later in a state where the operation lever 40 is located at the return position P1. Further, on the opposite side of the second contact surface 624 of the second transmitter 621 with respect to the pivoting shaft 20, a spring locking part 625 for locking a second end 632 of the elastic part 63 is provided.

In the limit switch 1, the first contact surface 614 of the first cam 61 and the second contact surface 624 of the second cam 62 are each disposed on the same virtual plane orthogonal to the extending direction of the pivoting shaft 20.

As illustrated in FIG. 4, the elastic part 63 is configured by a coil spring, is disposed between the first cam 61 and the second cam 62, and is connected to the pivoting shaft 20 in a state where the first end 631 is locked to the spring locking part 615 of the first cam 61 and second end 632 is locked to the spring locking part 625 of the second cam 62. The elastic part 63 energizes the operation lever 40 from the first motion position P2 toward the return position P1 via the first cam 61 and the pivoting shaft 20, and energizes the operation lever 40 from the second motion position P3 toward the return position P1 via the second cam 62 and the pivoting shaft 20.

The operation unit 3 includes a first cam's pivoting restriction part and a second cam's pivoting restriction part each provided inside the housing body 11.

As shown in FIG. 8, the first cam's pivoting restriction part includes the first contact surface 614 of the first cam 61 and the first contact protrusion 71 connected to the housing body 11. The first contact protrusion 71 extends from the inside of the housing body 11 toward the first contact surface 614, and is configured to contact the first contact surface 614 when the operation lever 40 is at the return position P1, thereby restricting the pivoting of the first cam 61 in the first direction A in which the operation lever 40 moves from the return position P1 toward the second motion position P3.

As illustrated in FIG. 8, the second cam's pivoting restriction part includes the second contact surface 624 of the second cam 62 and the second contact protrusion 72 connected to the housing body 11. The second contact protrusion 72 extends from the inside of the housing body 11 toward the second contact surface 624, and is configured to contact the second contact surface 624 when the operation lever 40 is at the return position P1, thereby restricting the pivoting of the second cam 62 in the second direction B in which the operation lever 40 moves from the return position P1 toward the first motion position P2.

Note that each of the first contact surface 614 and the second contact surface 624 are formed by, for example, crushing the end of the first transmitter 611 on the downstream side in the first direction and the end of the second transmitter 621 on the downstream side in the second direction.

In the limit switch 1, the operation unit 3 includes the pivoting shaft support 50 that permits the pivoting of the pivoting shaft 20 with respect to the housing body 11 in a state of an external force along the extending direction of the pivoting shaft 20 being not applied to the operation lever 40, and contacts the peripheral wall 12 to support the pivoting shaft 20 in a state of the external force along the extending direction of the pivoting shaft 20 being applied to the operation lever 40. The pivoting shaft support 50 can prevent the deformation of the pivoting shaft 20 due to an external force along the extending direction of the pivoting shaft 20, so that it is possible to achieve the limit switch 1 that is less likely to break down.

The pivoting shaft support 50 includes the annular second bearing 51 disposed over the circumference of the pivoting shaft 20. This makes it possible to prevent the deformation of the pivoting shaft 20 at an arbitrary position around the pivoting shaft 20 due to an external force along the extending direction of the pivoting shaft 20.

In the limit switch 1, the operation unit 3 includes the operation unit detachably connected to the switch body 2, and in the operation unit 3, the pivoting shaft 20 includes the protrusion 21 that extends in the radial direction with respect to the pivoting shaft 20, and the bearing 30 includes the pivoting restriction part 31 that is disposed around the pivoting shaft 20 so as to be able to contact the protrusion 21, and restricts the pivoting of the protrusion 21 around the pivoting shaft 20. That is, the limit switch 1 restricts the pivoting of the pivoting shaft 20 not on the inside of the switch body 2 or the operation unit 3 but at the pivoting shaft 20 and the bearing 30, thereby restricting the pivoting of the operation lever 40. Thereby, even when an external force of a magnitude larger than expected is applied to the operation lever 40 from the pivoting direction thereof, it is possible to prevent the breakage of the drive component that turns on and off the contact mechanism, such as the cams 61, 62, and hence the limit switch 1 can be repaired simply by replacing the operation unit, for example. That is, it is possible to achieve the limit switch 1 that is easy to repair and has high convenience.

The operation unit 3 includes the cylindrical peripheral wall 12 surrounding the bearing 30 around the pivoting shaft 20 outside the housing body 11, and the sealer 13 that is disposed further away from the inside of the housing body 11 than the bearing 30 within the peripheral wall 12 and in the extending direction of the pivoting shaft 20 and seals the inside of the housing body 11. The protrusion 21 is disposed closer to the inside of the housing body 11 than the sealer 13 in the extending direction of the pivoting shaft 20. Hence it is possible to prevent the breakage of the drive component that turns on and off the contact mechanism units, such as the cams 61, 62 while sealing the inside of the operation unit 3, so that the convenience of the limit switch 1 can be further improved.

The pivoting shaft 20 is provided with the protrusion 21 extending outward in the radial direction from the pivoting shaft 20, and the bearing 30 is provided with the pivoting restriction part 31. This makes it possible to easily achieve the limit switch 1 easy to repair and having high convenience.

The protrusion 21 is configured by a separate member from that of the pivoting shaft 20, and the pivoting shaft 20 has the recess 22 extending in a direction intersecting with the extending direction of the pivoting shaft 20 to house and hold the protrusion 21. Thus, for example, by using a material with a higher degree of hardness than the pivoting shaft 20 to constitute the protrusion 21, the strength of the protrusion 21 can be increased.

In the limit switch 1, the operation unit 3 includes: the elastic part 63 that energizes the operation lever 40 from the first motion position P2 toward the return position P1 via the pivoting shaft 20 and the first cam 61 and energizes the operation lever 40 from the second motion position P3 to the return position P1 via the pivoting shaft 20 and the second cam 62; the first cam's pivoting restriction part 614, 71 that restricts the pivoting of the first cam 61 in the first direction Ain which the operation lever 40 moves from the return position P1 to the second motion position P3; and the second cam's pivoting restriction part 624, 72 that restricts the pivoting of the second cam in the second direction B in which the operation lever 40 moves from the return position P1 to the first motion position P2. The elastic part 63, the first cam's pivoting restriction part 614, 71 and the second cam's pivoting restriction part 624, 72 can reduce the swing of the operation lever 40 at the return position P1 to immediately stop the operation lever 40 at the return position P1. As a result, it is possible to achieve the limit switch 1 that can reduce the variation of the return position P1 of the operation lever 40 and operate accurately.

Further, the first cam's pivoting restriction part includes a first contact surface 614 provided at the end of the first transmitter 611 on the downstream side in the second direction B in which the operation lever 40 moves from the return position P1 toward the first motion position P2, and the first contact protrusion 71 that is connected to the housing body 11, and contacts the first contact surface 614 when the operation lever 40 is at the return position P1, to restrict the pivoting of the first cam 61 in the first direction A. The second cam's pivoting restriction part includes a second contact surface 624 provided at the end of the second transmitter 621 on the downstream side in the first direction A, and the second contact protrusion 72 that is connected to the housing body 11, and contacts the second contact surface 624 when the operation lever 40 is at the return position P1, to restrict the pivoting of the second cam 62 in the second direction B. This makes it possible to further reduce the swing of the operation lever 40 at the return position P1.

Note that the limit switch 1 is not limited to the above embodiment, but any configuration can be employed so long as the operation unit 3 includes the pivoting shaft support 50. For example, the pivoting shaft support 50, the first cam's pivoting restriction part, and the second cam's pivoting restriction part may be omitted.

Figure 9:
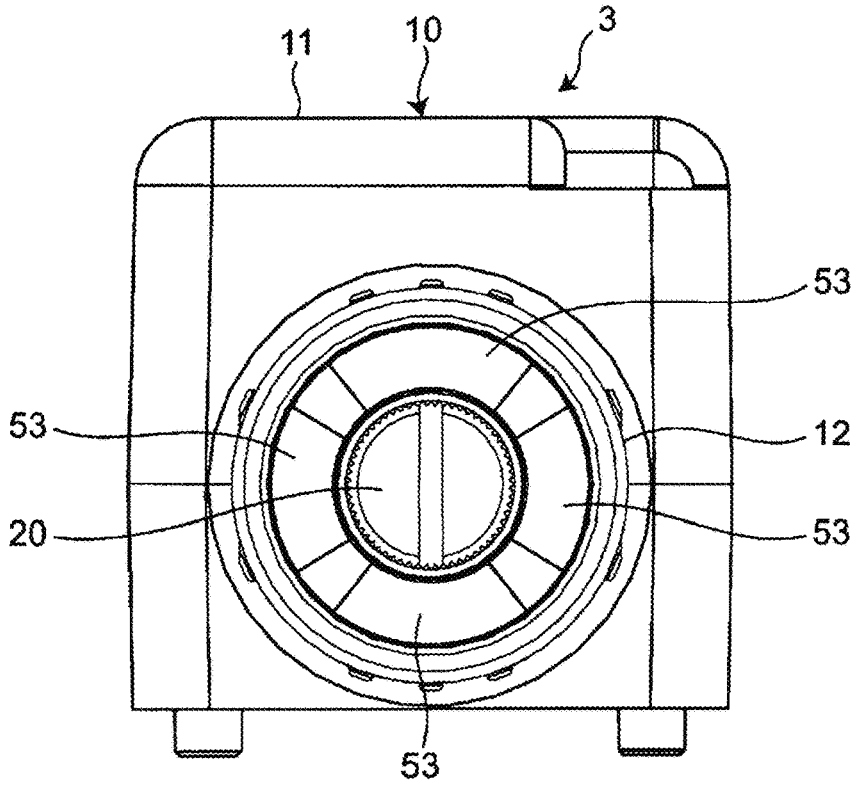
FIG. 9 is a front view illustrating a first modification of the limit switch in FIG. 1.

The pivoting shaft support 50 is not limited to being configured by the substantially annular second bearing 51 disposed over the circumference of the pivoting shaft 20. For example, as illustrated in FIG. 9, the pivoting shaft support 50 may be configured by a projection 53 extending outward in the radial direction from the pivoting shaft 20. As an example, a plurality of projections 53 are provided and arranged at intervals in the circumferential direction of the pivoting shaft 20. As described above, any configuration can be employed in the pivoting shaft support 50 so long as being a configuration where the pivoting shaft support 50 can permit the pivoting of the pivoting shaft 20 in a state where the external force F along the extending direction of the pivoting shaft 20 is not applied to the operation lever 40, and the pivoting shaft support 50 can contact the peripheral wall 12 to support the pivoting shaft 20 in a state where the external force along the extending direction of the pivoting shaft 20 is applied to the operation lever 40. That is, it is possible to achieve the limit switch 1 that is less likely to break down and has high flexibility in design.

Figure 10:
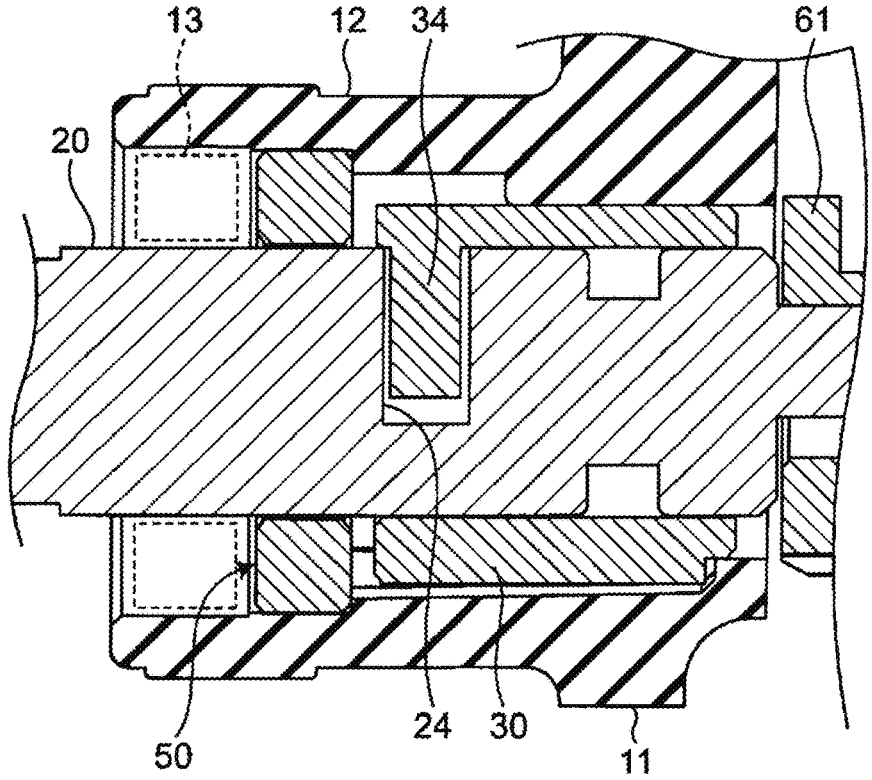
FIG. 10 is a sectional view taken along line in FIG. 2, illustrating a second modification of the limit switch in FIG. 1.

The protrusion is not limited to the pivoting shaft 20, but for example, as illustrated in FIG. 10, the protrusion may be a protrusion 34 extending in a direction orthogonal to the pivoting shaft 20 from the inner circumferential surface of the bearing 30 facing the pivoting shaft 20. The pivoting shaft 20 in FIG. 10 is provided with a groove-shaped pivoting restriction part 24 that can house the protrusion 34 of the bearing 30 and extends in the circumferential direction of the pivoting shaft 20.

The protrusion 21 is not limited to being configured by a separate member from that of the pivoting shaft 20 but may be integrally configured by the same member as that of the pivoting shaft 20.

Figure 11:
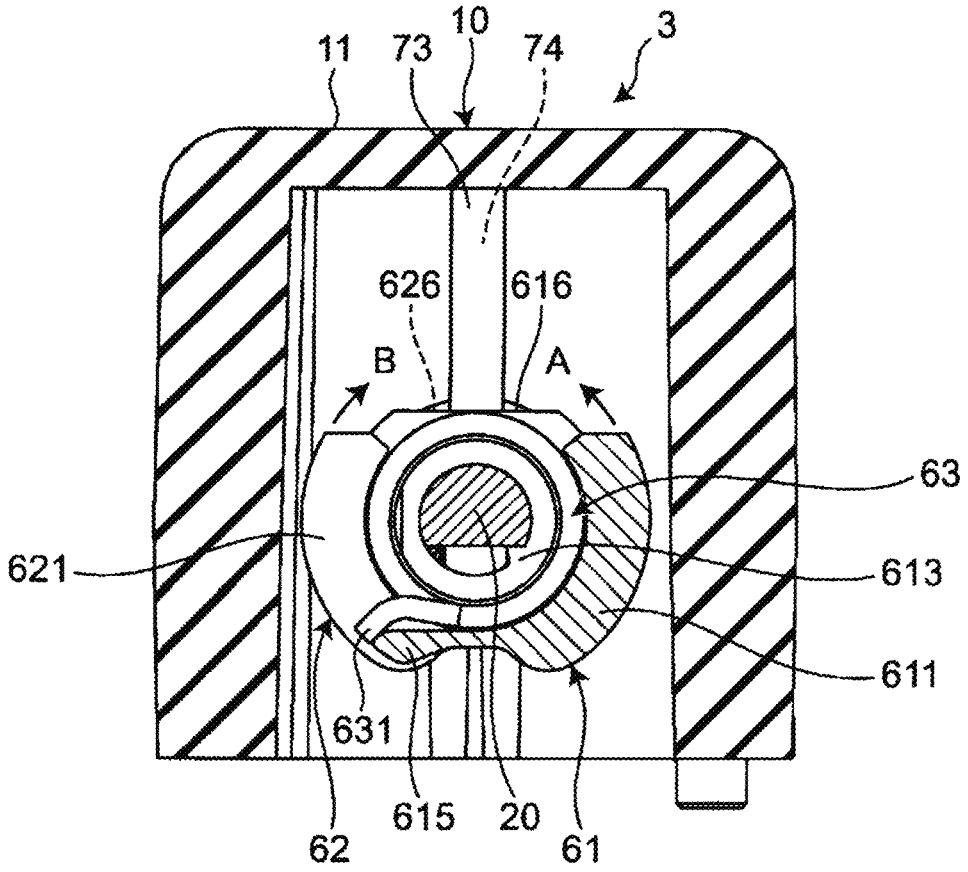
FIG. 11 is a sectional view taken along line VIII-VIII in FIG. 2, illustrating a third modification of the limit switch in FIG. 1.

The first cam's pivoting restriction part and the second cam's pivoting restriction part are respectively not limited to being configured by the contact surfaces 614, 624 and the contact protrusions 71, 72. For example, as illustrated in FIG. 11, the first cam's pivoting restriction part may be configured by a third contact surface 616 and a first elastic stopper 73, and the second cam's pivoting restriction part is configured by a fourth contact surface 626 and a second elastic stopper 74. The third contact surface 616 and the fourth contact surface 626 are respectively disposed between the first transmitter 611 and the second transmitter 621 so as to face the housing body 11 in the extending direction of the operation lever 40 (i.e., upward in FIG. 11) as viewed from the extending direction of the pivoting shaft 20 when the pivoting shaft 20 is located at the return position P1. The first elastic stopper 73 and the second elastic stopper 74 contact the third contact surface 616 and the fourth contact surface 626, respectively, and energize the respective cams 61, 62 in a direction orthogonal to the pivoting shaft 20.

For example, each of the first contact protrusion 71 and the second contact protrusion 72 may be configured by the same member as that of the housing body 11 or may be configured by a separate member (e.g., an elastic member such as rubber, a set screw, or a shim) from that of the housing body 11.

As described above, any configuration can be employed in each of the first cam's pivoting restriction part and the second cam's pivoting restriction part so long as being a configuration where the pivoting of the first cam 61 in the second direction B or the pivoting of the second cam 62 in the first direction A can be restricted. That is, it is possible to achieve the limit switch 1 that can accurately be operated and has high flexibility in design.

The peripheral wall 12 is not limited to being provided integrally with the housing 10 but may be provided separately. In this case, the peripheral wall 12 may be made of the same material as the housing body 11 or may be made of a different material therefrom.

In the above, various embodiments of the present disclosure have been described in detail with reference to the drawings. Finally, various aspects of the present disclosure will be described. In the following description, reference numerals will be added as examples.

A limit switch 1 according to the first aspect of the present disclosure is provided with:

a switch body 2 having a contact mechanism inside; and an operation unit 3 detachably connected to the switch body 2.

The operation unit 3 includes a housing body 11 connected to the switch body 2, a pivoting shaft 20 extending from an outside of the housing body 11 to an inside of the housing body 11 and pivotable around an extending direction of the pivoting shaft 20, a bearing 30 that is provided in the housing body 11 and pivotably supports the pivoting shaft 20, and an operation lever 40 that is connected to the pivoting shaft 20 outside the housing body 11, and pivots the pivoting shaft 20 to turn on and off the contact mechanism, one of the pivoting shaft 20 and the bearing 30 includes a protrusion 21, 34 that extends in a radial direction with respect to the pivoting shaft 20, and the other of the pivoting shaft 20 and the bearing 30 includes a pivoting restriction part 31, 24 that is disposed around the pivoting shaft 20 so as to be able to contact the protrusion 21, 34, and restricts pivoting of the protrusion 21, 34 around the pivoting shaft 20.

According to the limit switch 1 of the first aspect, even when an external force of a magnitude larger than expected is applied to the operation lever 40 from the pivoting direction thereof, it is possible to prevent the breakage of the drive component that turns on and off the contact mechanism, such as the cams 61, 62, and hence the limit switch 1 can be repaired simply by replacing the operation unit, for example. That is, it is possible to achieve the limit switch 1 that is easy to repair and has high convenience.

In the limit switch 1 according to the second aspect of the present disclosure, the operation unit 3 includes a cylindrical peripheral wall 12 surrounding the bearing 30 around the pivoting shaft 20 outside the housing body 11, and a sealer 13 that is disposed further away from the inside of the housing body 11 than the bearing 30 within the peripheral wall 12 and in the extending direction of the pivoting shaft 20 and seals the inside of the housing body 11.

The protrusion 21, 34 is disposed closer to the inside of the housing body 11 than the sealer 13 in the extending direction of the pivoting shaft 20.

According to the limit switch 1 of the second aspect, it is possible to prevent the breakage of the drive component that turns on and off the contact mechanism units, such as the cams 61, 62, while sealing the inside of the operation unit 3, so that the convenience of the limit switch 1 can be further improved.

In the limit switch 1 according to the third aspect of the present disclosure, the pivoting shaft 20 is provided with the protrusion 21 extending outward in the radial direction from the pivoting shaft 20, and the bearing 30 is provided with the pivoting restriction part 31.

According to the limit switch 1 of the third aspect, it is possible to easily achieve the limit switch 1 that is easy to repair and has high convenience.

In the limit switch 1 according to the fourth aspect of the present disclosure, the protrusion 21 is configured by a separate member from that of the pivoting shaft 20, and the pivoting shaft 20 has a recess 22 extending in a direction intersecting with the extending direction of the pivoting shaft 20 to house and hold a part of the protrusion 21.

According to the limit switch 1 of the fourth aspect, for example, the protrusion 21 is configured by a material with a higher degree of hardness than that of the pivoting shaft 20, so that the strength of the protrusion 21 can be enhanced.

By appropriately combining any of the various embodiments or modifications described above, the effects of the respective embodiments or modifications can be achieved. In addition, a combination of embodiments, a combination of examples, or a combination of an embodiment and an example is possible, and a combination of features in different embodiments or examples is also possible.

Although the present disclosure has been fully described in connection with the preferred embodiments with reference to the accompanying drawings, various variations and modifications will be apparent to those skilled in the art. It is to be understood that, so long as not departing from the scope of the present disclosure as set forth in the appended claims, the variations and modifications as thus described are included therein.

INDUSTRIAL APPLICABILITY

The limit switch of the present disclosure can be applied to, for example, an assembly line of an automobile or the like.

DESCRIPTION OF REFERENCE SIGNS

1. limit switch
2. switch body
3. operation unit
10. housing
11. housing body
12. peripheral wall
121. inner circumferential surface
13. sealer
20. pivoting shaft
21. protrusion
22. recess
23. locking surface
24. pivoting restriction part
30. bearing
31. pivoting restriction part
32. first end
33. second end
34. protrusion
40. operation lever
41. roller
50. pivoting shaft support
51. second bearing
52. end
53. projection
61. first cam
611. first transmitter
612. through-hole
613. locking protrusion
614. first contact surface
615. spring locking part
616. third contact surface
62. second cam
621. second transmitter
622. through-hole
623. locking protrusion
624. second contact surface
625. spring locking part
626. fourth contact surface
63. elastic part
631. first end
632. second end
71. first contact protrusion
72. second contact protrusion
73. first elastic stopper
74. second elastic stopper
P1. return position
P2. first motion position
P3. second motion position
A. first direction
B. second direction
L. pivot axis

The invention claimed is:

1. A limit switch comprising:

a switch body having a contract mechanism inside; and an operation unit detachably connected to the switch body, wherein the operation unit comprises a housing body connected to the switch body, a pivoting shaft extending from an outside of the housing body to an inside of the housing body and pivotable around an extending direction of the pivoting shaft, a bearing that is provided in the housing body and pivotably supports the pivoting shaft, and an operation lever that is connected to the pivoting shaft outside the housing body, and pivots the pivoting shaft to turn on and off the contact mechanism, wherein one of the pivoting shaft and the bearing comprises a protrusion that extends in a radial direction with respect to the pivoting shaft, and the other of the pivoting shaft and the bearing comprises a pivoting restriction part that is disposed around the pivoting shaft so as to be able to contact the protrusion, and restricts pivoting of the protrusion around the pivoting shaft, wherein the operation unit comprises a cylindrical peripheral wall surrounding the bearing around the pivoting shaft outside the housing body, and a sealer that is disposed further away from the inside of the housing body than the bearing within the peripheral wall and in the extending direction of the pivoting shaft and seals the inside of the housing body, the protrusion is disposed closer to the inside of the housing body than the sealer in the extending direction of the pivoting shaft.

2. A limit switch comprising:

a switch body having a contract mechanism inside; and an operation unit detachably connected to the switch body, wherein the operation unit comprises a housing body connected to the switch body, a pivoting shaft extending from an outside of the housing body to an inside of the housing body and pivotable around an extending direction of the pivoting shaft, a bearing that is provided in the housing body and pivotably supports the pivoting shaft, and an operation lever that is connected to the pivoting shaft outside the housing body, and pivots the pivoting shaft to turn on and off the contact mechanism, wherein one of the pivoting shaft and the bearing comprises a protrusion that extends in a radial direction with respect to the pivoting shaft, and the other of the pivoting shaft and the bearing comprises a pivoting restriction part that is disposed around the pivoting shaft so as to be able to contact the protrusion, and restricts pivoting of the protrusion around the pivoting shaft, wherein the protrusion is configured by a separate member from that of the pivoting shaft, and the pivoting shaft has a recess extending in a direction intersecting with the extending direction of the pivoting shaft to house and hold a part of the protrusion.

* * * * *